US007267327B2

(12) United States Patent
Sasaki et al.

(10) Patent No.: US 7,267,327 B2
(45) Date of Patent: Sep. 11, 2007

(54) THROTTLE VALVE ASSEMBLY AND DUST SEAL FOR A CARBURETOR

(75) Inventors: Masashi Sasaki, Kakuda (JP); Hitoshi Terakada, Sendai (JP)

(73) Assignee: Walbro Japan, Inc., Tokyo (JP)

( * ) Notice: Subject to any disclaimer, the term of this patent is extended or adjusted under 35 U.S.C. 154(b) by 253 days.

(21) Appl. No.: 10/974,518

(22) Filed: Oct. 27, 2004

(65) Prior Publication Data

US 2005/0104235 A1 May 19, 2005

(30) Foreign Application Priority Data

Nov. 14, 2003 (JP) ..... 2003-385317
Nov. 14, 2003 (JP) ..... 2003-385319
Apr. 23, 2004 (JP) ..... 2004-128083

(51) Int. Cl.
*F02M 9/08* (2006.01)

(52) U.S. Cl. ..... 261/44.6; 261/44.8

(58) Field of Classification Search ..... 261/44.6–44.8
See application file for complete search history.

(56) References Cited

U.S. PATENT DOCUMENTS

| | | | | |
|---|---|---|---|---|
| 2,062,496 | A | 12/1936 | Brokel | 261/44.3 |
| 3,698,367 | A | 10/1972 | Goodwin | 123/529 |
| 3,985,839 | A | 10/1976 | Edmonston | 261/44.3 |
| 4,481,152 | A | 11/1984 | Kobayashi et al. | 261/35 |
| 4,481,153 | A | 11/1984 | Kobayashi et al. | 261/44.2 |
| 5,599,484 | A | 2/1997 | Tobinai | 261/44.2 |
| 5,709,822 | A | 1/1998 | Togashi | 261/44.2 |
| 5,942,160 | A | 8/1999 | Araki | 261/44.8 |
| 6,231,033 | B1 * | 5/2001 | Araki | 261/44.8 |
| 6,394,425 | B1 * | 5/2002 | Nagata | 261/44.8 |
| 7,007,931 | B2 * | 3/2006 | Tobinai | 261/44.6 |
| 2003/0111743 | A1 * | 6/2003 | Ohgane et al. | 261/44.8 |
| 2004/0017014 | A1 * | 1/2004 | Tobinai | 261/64.2 |

FOREIGN PATENT DOCUMENTS

| | | |
|---|---|---|
| FR | 526113 | 10/1921 |
| JP | 60019969 | 2/1985 |
| JP | 6129303 | 5/1994 |

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor has a throttle valve assembly with a cam member and cam surface internally arranged in a body of the carburetor. The cam member is carried by the throttle valve body and preferably has outwardly extending tabs for locking engagement within slots formed in the throttle valve body. The throttle valve body has a dust seal constructed from an elastomeric material. The dust seal has one end sized for a tight resilient fit about a boss extending upwardly from a cap of the carburetor, and another end sized for tight resilient fit about a shaft carried by the throttle valve body, and a mid-section expanded over a flange.

34 Claims, 3 Drawing Sheets

THROTTLE VALVE ASSEMBLY AND DUST SEAL FOR A CARBURETOR

REFERENCE TO RELATED APPLICATION

Applicants claim the benefit of the following Japanese Patent Applications: Ser. No. 2003-385317, filed Nov. 14, 2003; Ser. No. 2003-385319, filed Nov. 14, 2003; and Ser. No. 2004-128083, filed Apr. 23, 2004.

FIELD OF THE INVENTION

The present invention relates generally to carburetors, and more particularly to throttle valves and dust seals for use in carburetors.

BACKGROUND OF THE INVENTION

Throttle valves in carburetors for small internal combustion engines adjust the air-fuel mixture supplied to the engine. The throttle valves are commonly supported for rotation in a mixing passage of the carburetor to selectively open and close the mixing passage. In additional to rotational movement, throttle valves are known to be axially moveable to displace a needle valve within a fuel nozzle to regulate the rate of fuel flow into the mixing passage.

The axial movement of the throttle valve is controlled by a cam assembly including a cam follower carried by the carburetor and a cam provided on a lever coupled to the throttle valve for mating engagement with the cam. As the throttle valve lever is rotated, the throttle valve rotates about its longitudinal axis to regulate the flow of air through the mixing passage and moves axially to regulate the flow of liquid fuel into the mixing passage.

As a result of the cam assembly being disposed outside of the carburetor body, dust and debris can accumulate between the cam and the cam follower. As such, the movement of the throttle valve is adversely affected, thereby resulting in inefficient, unsteaady or undesirable engine performance. Further, the accumulation of contamination, such as dust, can reduce the life of the throttle valve assembly and related components.

SUMMARY OF THE INVENTION

A throttle valve assembly having a valve body received in a valve chamber of a carburetor body of an internal combustion engine with an end adjacent a base of the valve chamber, and a through bore rotatably received in a mixing passage of the carburetor body to regulate at least in part the air-fuel mixture flowing through the mixing passage. A needle valve extends into the through bore of the valve body for conjoint rotation with the valve body, and is partially received in a passage of a fuel nozzle. A cam member constructed as a separate piece of material from the valve body is carried by the end of the valve body received in the valve chamber. The cam member has at least one axially inclined cam surface to move the valve body axially in response to rotational movement of the vale body about its axis.

According to another aspect of the invention, the throttle valve assembly has a cap carried by the carburetor body with a boss extending upwardly from a upper surface of the cap to define a least in part an opening through the cap. A flange extends radially outwardly from the boss to define an annular recess between the flange and the upper surface. A shaft is carried by the valve body and is sized for receipt through the opening in the cap. A seal having a tubular wall has one end sized for a generally tight resilient fit in the recess and another end sized for a generally tight resilient fit about the support shaft axially above the boss.

Some of the objects, features and advantages of the invention include providing a throttle valve assembly for use in a carburetor for an internal combustion engine that has a cam assembly that is substantially free from contamination, constructed as a separate piece from a throttle valve body, economical in manufacture, relatively light weight, resiliently maintained in operable connection to a throttle valve body, improves the efficiencies in manufacturing and assembly of a carburetor, provides for precise location of a cam member, is relatively simple in design and manufacture, and a dust seal that is of relatively simple design, economical in manufacture, and in use has a long and useful life.

BRIEF DESCRIPTION OF THE DRAWINGS

These and other objects, features and advantages of this invention will become readily apparent in view of the following detailed description of the presently preferred embodiments and best mode, appended claims and accompanying drawings, in which:

DETAILED DESCRIPTION OF THE PREFERRED EMBODIMENTS

Figure 1:
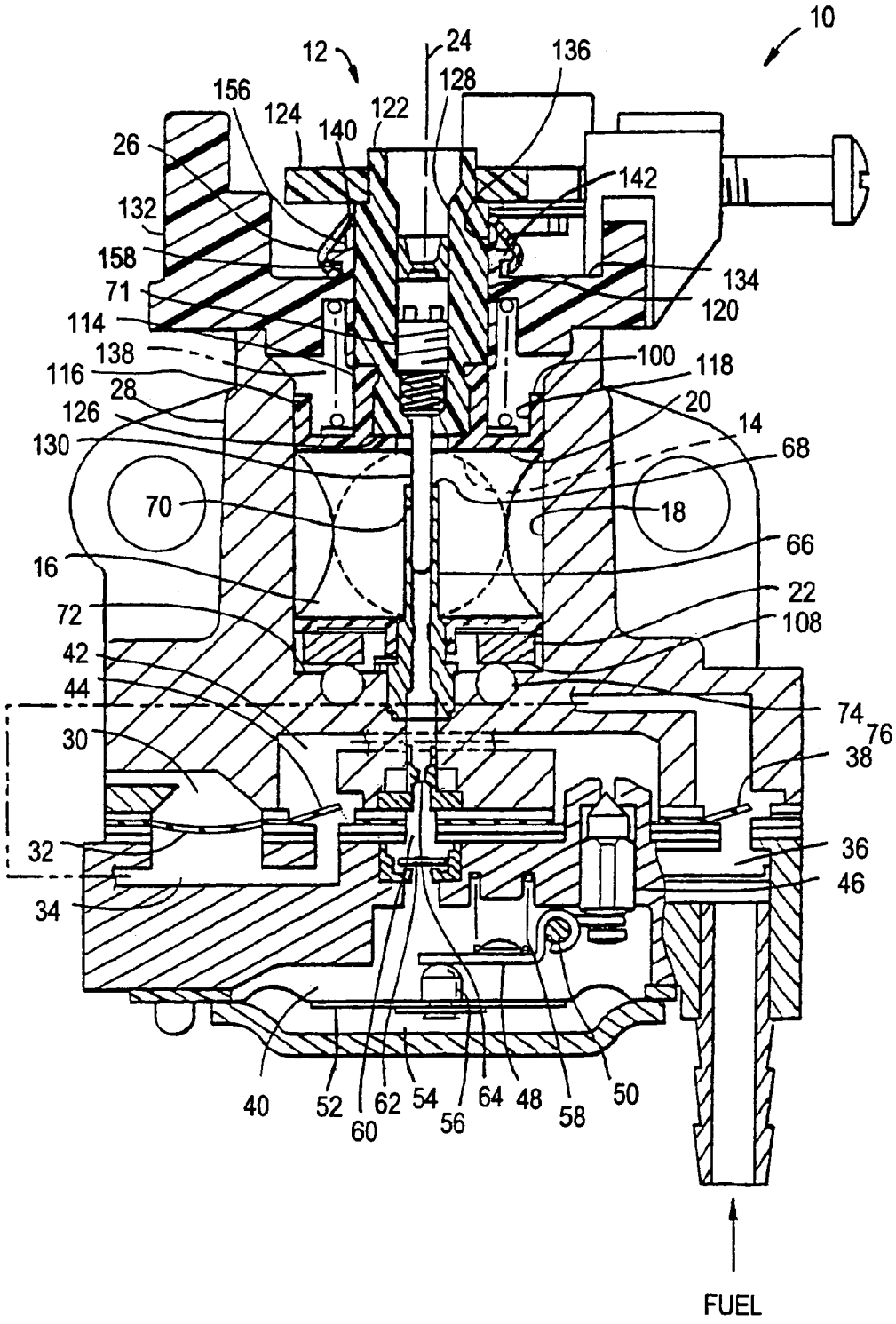
FIG. 1 is cross sectional view of a carburetor having a throttle valve and a dust seal constructed according to one presently preferred embodiment of the invention.

Referring in more detail to the drawings, FIG. 1 illustrates a carburetor 10 having a throttle valve assembly 12 constructed according to one presently preferred embodiment of the invention. The carburetor 10 has an intake or fuel and air mixing passage 14 extending generally perpendicular to the paper, as viewed in FIG. 1. The throttle valve assembly 12 has a rotary throttle valve 16 received in a throttle valve chamber 18 with a through bore 20 of the throttle valve 16 received at least in part in the mixing passage 14. A cam member 22 is in operable communication with one end of the throttle valve assembly 12 to facilitate axial movement of the throttle valve 16 along a longitudinal axis 24 extending generally perpendicular to the mixing passage 14. As such, as the throttle valve 16 is rotated between generally open and closed positions about the axis 24, the throttle valve affects the flow rate of air through the mixing passage 14, while the axial movement affects the flow rate of liquid fuel into the mixing passage 14. To facilitate efficient operation of the throttle valve assembly 12 and to extend the useful life of the carburetor 10, preferably a dust seal 26 is provided to prevent the ingress of contamination into the throttle valve chamber 18.

The carburetor 10 has a body 28 preferably constructed from a metallic material with a pulsating pressure chamber 30 communicating with a crankcase of an engine (not shown) to received pulsating pressure therefrom. A pump diaphragm 32 separates the pressure chamber 30 from a pump chamber 34 defined on the other side of the pump diaphragm 32. The pump chamber 34 communicates with an external fuel tank (not shown) via a passage 36 defined in the main body 28. Desirably, the passage 36 has a one way check valve 38 to facilitate regulating the flow of liquid fuel between the fuel tank and the pump chamber 34. As the pump diaphragm 32 reciprocates under the pulsating pressure from the crankcase, the check valve 38 allows liquid fuel to flow to the pump chamber 34, while preventing the reverse flow of liquid fuel from the pump chamber 34 back toward the fuel tank.

The pump chamber 34 is in fluid communication with a fuel control or metering chamber 40 defined in a lower portion of the main body 28 via a passage 42. The passage 42 preferably has a one way check valve 44 to control in part the flow of liquid fuel between the pump chamber 34 and the metering chamber 40. The check valve 44 closes when the pump diaphragm 32 draws fuel from the fuel tank, and opens when the pump diaphragm 32 acts to discharge or pump fuel.

To further control the flow of liquid fuel through the passage 42 and into the metering chamber 40, an inlet valve 46 moveable between open and close positions preferably is interposed generally between the metering chamber 40 and the check valve 44. The inlet valve 46 has a lever 48 pivotally supported by a pivot shaft 50 inside the metering chamber 40. When the inlet valve 46 is in its open position, liquid fuel is generally free to flow into the metering chamber 40, and when in its closed position, liquid fuel is prevented from entering the metering chamber 40.

The metering chamber 40 is defined in part by a diaphragm 52, with an atmospheric chamber 54 defined on an opposite side of the diaphragm 52 from the metering chamber 40. The diaphragm 52 has a central projection 56 that abuts the lever 48 to regulate its movement about the pivot shaft 50, and thus, the movement of the inlet valve 46 between its open and closed positions. When the pressure in the metering chamber 40 is less than the pressure in the atmosphere chamber 54, the diaphragm 52 deflects upwardly, and thus, the projection 56 engages the lever 48 and pivots it about the pivot shaft 50 in a clockwise direction, as viewed in FIG. 1, thereby moving the inlet valve 46 to its open position. When the pressure in the metering chamber 40 is equal to or less than the pressure in the atmospheric chamber 54, the inlet valve 46 remains in its closed position. To facilitate maintaining the inlet valve 46 in its closed position when the pressure in the metering chamber 40 is equal to or less than the pressure in the atmospheric chamber 54, preferably a spring 58 biases the lever 48 to its closed position.

The metering chamber 40 is in fluid communication with the mixing passage 14 via a fuel passage 60. Desirably, the fuel passage 60 includes a one way check valve 62 and a main fuel jet 64 downstream from the check valve 62. The fuel passage 60 is defined in part by a fuel nozzle 66 disposed in the carburetor body downstream from the main fuel jet 64, such as though a press fit or threaded engagement, for example, at one end of the fuel nozzle 66. The fuel nozzle 66 has a free end 68 terminating within the through bore 20 of the throttle valve 16 and has a main orifice 70 preferably formed in a sidewall of the fuel nozzle 66 generally adjacent the free end 68 for operable communication with a needle valve 71.

The throttle valve chamber 18, in which the throttle valve 16 is slidably and rotatably received, extends to a base 72 that is preferably formed with one or more cam followers 74 extending outwardly therefrom. The cam followers 74 are represented here, by way of example and without limitation, as being a pair of balls preferably press fit or otherwise received in a pair of pockets 76 formed in the base 72.

Figure 2:
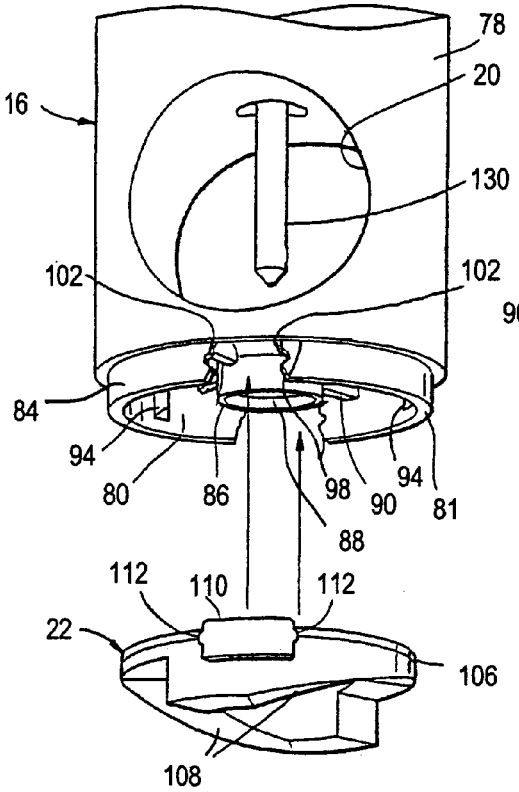
FIG. 2 is a fragmentary exploded perspective view of the throttle valve and a cam member of FIG. 1.
Figure 3:
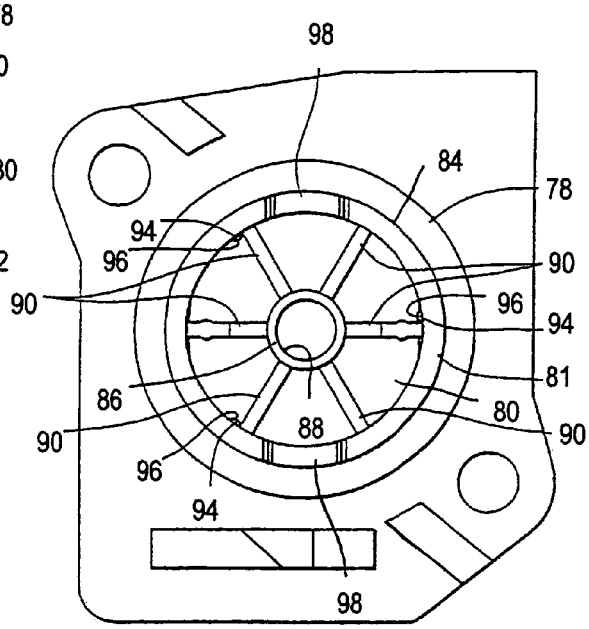
FIG. 3 is a view of the throttle valve looking in the direction of the arrows in FIG. 2.
Figure 4:
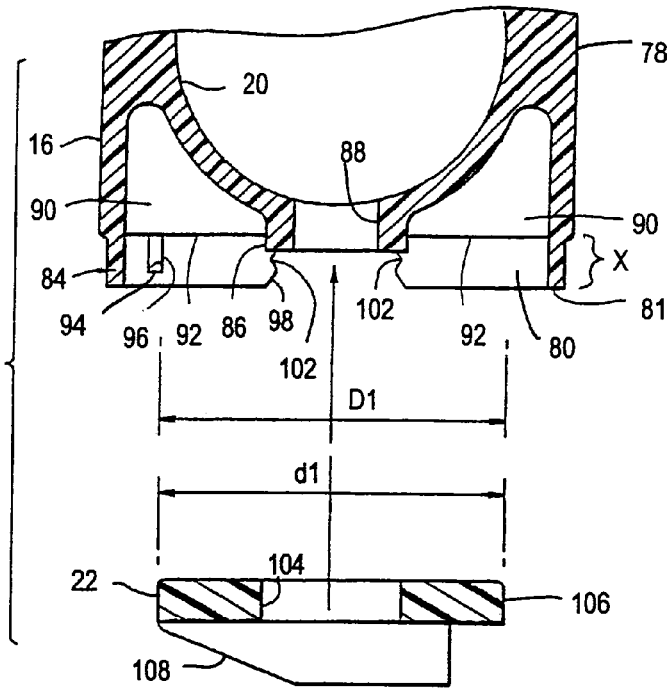
FIG. 4 is a fragmentary exploded cross sectional view of the throttle valve and cam member.

As best shown in FIGS. 2 and 4, the throttle valve 16 has a generally cylindrical body 78, preferably constructed from a polymeric material, such as by a molding process for example. A recessed pocket or channel 80 extends axially inwardly from one end 81 to define an outer wall 84 and a radially inwardly spaced concentric annular boss 86. The boss 86 has an opening 88 in which the fuel nozzle 66 is received. As best shown in FIG. 3, a plurality of ribs, and preferably six ribs 90, extend radially across portions of the channel 80 between the boss 86 and the wall 84, wherein the ribs 90 function at least in part to facilitate reinforcing the wall 84. Desirably, the ribs 90 have a lower surface 92 (FIG. 4) spaced axially inwardly a predefined distance (X) from the end 81 and referred to hereafter as the first end 81 of the throttle valve body 78 to facilitate locating the cam member 22 within the channel 80 during assembly, and to provide axial support to the cam member 22 in use.

As shown best in FIG. 3, the wall 84 of the throttle valve body 78 has a plurality of axially extending ribs, shown here by example as three axially extending ribs 94, protruding radially inwardly from the wall 84 into at least a portion of the channel 80. Preferably, the ribs 94 are spaced circumferentially at regular angular intervals, shown here as being spaced about one-hundred-twenty degrees from one another. The ribs 94 terminate at tips 96 that define an imaginary circle having a predefined diameter D1 (FIG. 4) to facilitate locating the cam member 22 radially within the recess 80. Desirably, the tips 96 receive or cooperate with the cam member 22 in a line-to-line or a slight interference fit.

As shown in FIGS. 2-4 and 5, the wall 84 of the throttle valve body 78 has at least one and shown here as a pair of circumferentially spaced slots 98 extending from the first end 81 of the body 78 axially toward a second end 100 (FIG. 1). The slots 98 preferably have at least one and shown here as a pair of notches 102 (FIGS. 2, 4 and 5) extending circumferentially into the wall 84 to facilitate snap-fit retention of the cam member 22.

The cam member 22 preferably is constructed from a polymeric material such as by a molding process, for example, and is received in the channel 80 in the first end 81 of the throttle valve body 78. As shown in FIG. 4, the cam member 22 has an opening 104 concentrically located relative to an outer surface 106, wherein the opening 104 is sized for receipt of the boss 86 of the throttle valve 16. As best shown in FIG. 2, the cam member 22 has at least one and shown here as a pair of circumferentially spaced and inclined cam surfaces 108. The cam surfaces 108 extend in a generally circumferential direction and are arranged for mating engagement with the cam followers or balls 74 in the base 72 of the carburetor body 28. Desirably, the cam surfaces 108 are inclined to move the throttle valve 16 axially, thereby raising and lowering the needle valve 71 within the passage 60 of the fuel nozzle 66 to increase and decreased, respectively, the flow rate of fuel through the main orifice 70 into the mixing passage 14.

Figure 5:
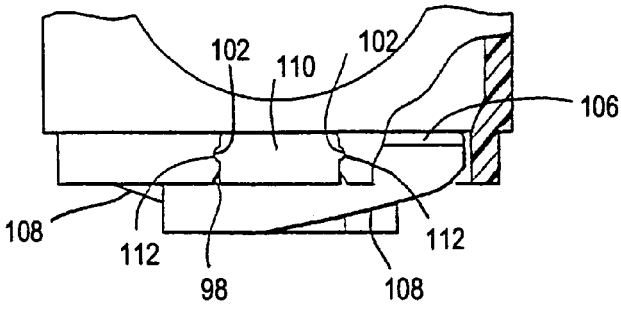
FIG. 5 is a fragmentary cross sectional view with a portion broken away of the throttle valve showing the cam member attached thereto.

As shown in FIGS. 2 and 5, the cam member 22 has at least one and shown here by way of example as having a pair of tabs 110 projecting radially outwardly from the outer surface 106. The tabs 110 are oriented to be received within the slots 98 in the throttle valve body 78. To facilitate maintaining the cam member 22 on the throttle valve body 78, each of the tabs 110 preferably has an outwardly and circumferentially extending projection 112 with the projections 112 sized and arranged for corresponding locking or snap-fit receipt in the notches 102 in the slots 98. Each tab is preferably closely received in its slot to limit or prevent relative rotation of the cam member 22 relative to the throttle valve body 78. Accordingly, in assembly, the cam member 22 may be resiliently snapped into locking engagement with the throttle valve body 78 by pressing the tabs 110 into the respective slots 98. Upon assembling the cam member 22 to the throttle valve body 78, the cam member 22 is secured to the body 78 and resists removal therefrom in use, and throughout subsequent assembly operations.

Referring to FIG. 4, the outer surface 106 of the cam member 22 has a diameter (d1) that cooperates with the diameter (D1) defined by tips 96 of the ribs 94 in the throttle valve body 78 so that the cam member 22 is received in the channel 80 with a line-to-line or slight interference fit. Accordingly, the diameter D1 of the tips 96 is preferably generally equal to or slightly less than the outer diameter d1 of the cam member 22. As such, upon assembling the cam member 22 to the throttle valve body 78, the cam member 22 is automatically centered in its desired position with respect to the throttle valve 16 so that the opening 104 in the cam member 22 is received about the annular boss 86 of the throttle valve 16. Further, the radially extending ribs 90 facilitate proper positioning of the cam member 22 relative to the throttle valve body 78 by limiting the axial insertion of the cam member 22 within the channel 80. As such, the desired engagement between the cam surfaces 108 and the balls 74 can readily be attained.

According to one presently preferred aspect of at least some embodiments of the invention, because the throttle valve body 78 and cam member 22 can be formed separately, they can be formed from different materials. For example, it may be preferable to form the throttle valve body 78 out of a material with a low frictional coefficient to facilitate rotation and axial movement of the throttle valve with respect to the carburetor body and adjacent components. It may also be preferable to form the cam member 22 out of a different material that is highly resistant to wear to ensure the integrity and consistency of the inclined cam surfaces 108 of the cam member 22. The throttle valve and cam member can be formed from any suitable material including metals, polymers, and the like. The throttle valve body and cam member may be independently treated, or have a surface independently treated to alter a material property or characteristic of the component in use. For example, the throttle valve body may be coated with a material providing reduced friction in use without having to likewise coat or treat the cam member. Different materials, treatments, coating and the like can provide one of the cam member and the valve body with at least one material characteristic or property, whether by way of a different material or not, that is not present in the other of the cam member and valve body. In addition to more efficient and consistent performance, costs may be reduced in this manner.

Figure 7:
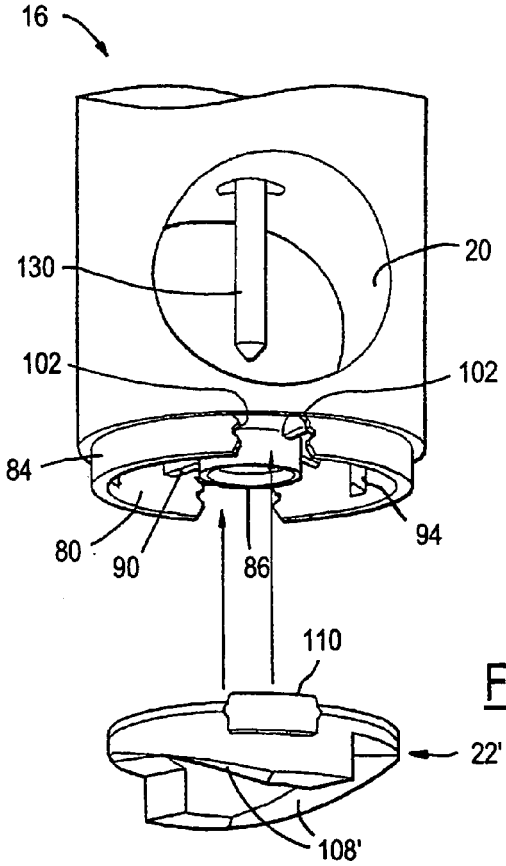
FIG. 7 is a fragmentary exploded perspective view of an alternate embodiment of a throttle valve and a cam member.

Still further, to change the operational characteristics of the carburetor, different cam members 22 can be fitted to similar throttle bodies, as desired. This facilitates tuning of the carburetor throughout the operational range of the throttle valve. This also facilitates use of the same carburetor components with throttle valves moved in opposite directions between their idle and wide open positions, such as may be dictated by different engine designs or layouts. For example, one engine may require clockwise rotation of the throttle valve from its idle position toward its wide open position, and another engine may require counterclockwise rotation of the throttle valve from its idle position toward its wide open position due to various design features or constraints. Both directions of throttle valve movement can be achieved by providing cam members 22 with appropriately oriented and inclined cam surfaces 108. For example, FIG. 7 illustrates a cam member 22' that has cam surfaces 108' oriented and inclined to actuate a throttle valve 16 that is operated in the reverse rotational direction of the throttle valve shown in FIG. 2. Otherwise, the throttle valve 16 and cam member 22' can be constructed as shown in FIG. 2. While shown attached to the valve body 78, the cam member 22 can be carried by the carburetor body 28 and the cam followers can be carried by the throttle valve body 78. The cam member 22 may be integral with or separate from and mounted on the carburetor body 28.

As shown in FIG. 1, the second end 100 of the throttle valve body 78 has an annular boss 114 spaced radially inwardly from an outer wall to 116 define a recessed channel 118 between the boss 114 and outer wall 116. The boss encircles 114 a through opening which passes into the through bore 20 of the throttle valve 16, wherein the through opening is sized for receipt of the needle valve 71 at least in part.

A generally cylindrical support shaft 120 has an upper end 122 adapted for attachment to a throttle lever 124 and lower end 126 adapted for attachment within the boss 114 of the throttle valve body 78. The support shaft 120 has a coaxial bore 128 with an internally threaded portion for attachment of the needle valve 71 therein.

The needle valve 71 has a needle 130 sized for close sliding receipt in the fuel nozzle 66 and an enlarge externally threaded portion sized for mating threaded engagement with the internally threaded portion of the support shaft 120. The needle 130 extends into the through bore 20 of the throttle valve body 78 and into the fuel nozzle 66, as shown in FIG. 1 with the needle 160 in a fully advanced position to substantially close the main orifice 70 in the fuel nozzle 66 to fuel flow. Preferably, to facilitate maintaining the needle 130 in its adjusted position, a spring is received about the needle 130 between the threaded portion of the needle valve 71 and the lower end of the support shaft 120.

Figure 6:
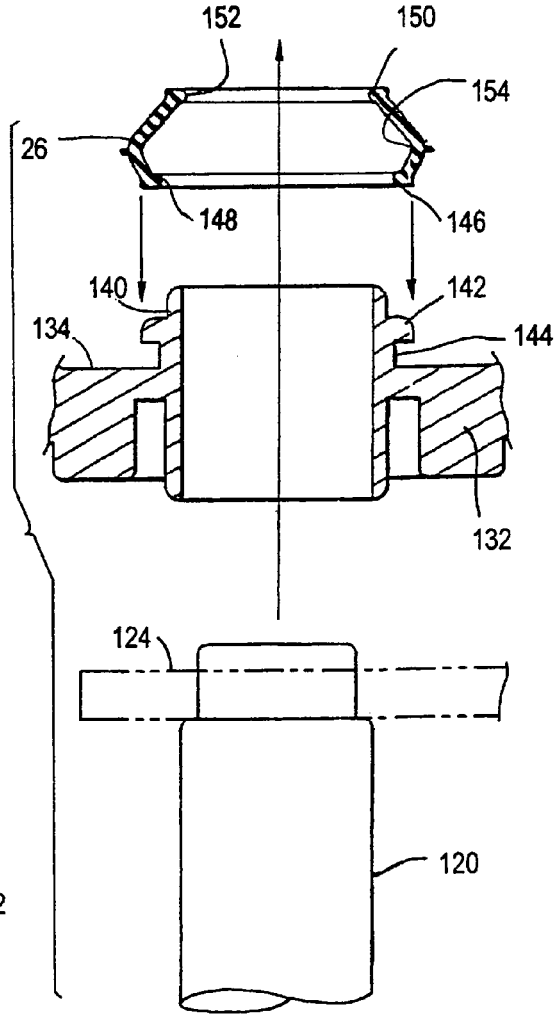
FIG. 6 is a fragmentary exploded cross-sectional view of a dust seal assembly constructed according to one presently preferred embodiment of the invention.

A lid or cap 132 is adapted for attachment to the carburetor body 28 and has an opening 136 sized to received the support shaft 120 for rotation therein. A lower side of the cap 132 has an annular recess in axial alignment with the channel 118 in the throttle valve body 78 for receipt of a coil spring 138 to bias the throttle valve 16 toward its closed position. As the throttle valve 16 is moved toward its wide open position, the bias imparted by the spring 138 is overcome, as desired. The cap 132 has an upper side 134 with a boss 140 extending upwardly therefrom to define in part the opening 136. As best shown in FIG. 6, the boss 140 has a radially outwardly extending annular flange 142 defining a recess 144 between the flange 142 and the upper side of the cap 132.

The dust seal 26, preferably constructed from a tubular piece of elastomeric material, is incorporated to create a seal between the support shaft 120 and the cap 132. As best shown in FIG. 6, the dust seal 26 has a lower end 146 with an opening 148 sized for a generally tight resilient fit within the recess 144 and about the boss 140 of the cap 132, and an upper end 150 having an opening 152 sized for a generally tight resilient fit about a portion of the support shaft 120 extending or exposed upwardly from the annular boss 140.

The resilient fit of the dust seal 26 preferably ensures that it remains generally stationary relative to the cap 132, and encounters movement relative to the support shaft 120 when the support shaft 120 is rotated and axially moved. It should be understood that the dust seal 26 generally will encounter some precess relative to the cap 132 in use.

The dust seal 26 has a mid section 154 that is engaged by the flange 142 on the boss 140 to place the dust seal in tension, to resist degradation of the dust seal and enhance its durability, even if the seal 26 is in not in use over extended periods of time. The elastomeric properties of the dust seal 26 allow the mid section 154 to stretch or expand radially outwardly to a diameter that is greater than the diameters at the ends 146, 150. As such, the mid section 154 generally has an enlarged circumference when received over the flange 142 to form axially spaced air pockets 156, 158 between the dust seal 26 and portions of the boss 140 above and below the flange 142, while allowing the ends 146, 150 of the dust seal 26 to remain in sealing engagement within the recess 144 and about the support shaft 120. The air pockets 156, 158 act as a barrier to facilitate an effective seal against the ingress of dust and other solid or liquid contaminants. The mid section 154 of the dust seal 26 may be formed having a slightly enlarged diameter, though maintaining an inner surface of the dust seal 26 with an at least slightly smaller diameter than the flange 142, thereby facilitating receipt of the dust seal 26 over the flange 142, while maintaining the dust seal 26 in tension. Accordingly, the dust seal 26 has three generally circumferential lines of contact upon assembly; one on the support shaft 120; one on the flange 142, and one on the boss 140 within the recess 144. With the lower end 146 of the dust seal 26 received resiliently in the recess 144, and with the flange 142 extending radially outwardly from the lower end 146 of the dust seal 26, the dust seal 26 resists being removed or dislodged from the cap 132 in use.

In use, and upon rotation of the throttle lever 124, the throttle valve 15 and the cam member 22 rotate conjointly thereby moving the cam surfaces 108 over the balls 74. As such, the throttle valve 16 not only rotates about the longitudinal axis 24, but also moves axially along the longitudinal axis 24. Accordingly, the axial movement of the throttle valve 16 as it moves toward its wide open position causes the needle 130 to move axially within the fuel nozzle 66 in a direction increasing the open area of the main orifice 70 to enable an increased flow rate of liquid fuel into the mixing passage 14. Otherwise, when the throttle valve 16 is moved toward its closed or idle position, the needle 130 moves axially within the fuel nozzle 66 in a direction decreasing the open area of the main orifice 70 tending to decrease the flow rate of liquid fuel into the mixing passage 14.

During this throttle valve movement, the upper end 150 of the dust seal 26 tends to experience rotational, or twisting, and sliding, or translational, movement relative to the support shaft 120. Therefore, the dust seal 26, preferably being constructed from an elastomeric material, is able to extend and contract in length as the support shaft 120 moves along the longitudinal axis 24. Though contracting and extending axially in use, the dust seal 26 remains compliant, in tension, and thus, resists premature wear and degradation, even when having not been in use for extended periods of time. In addition, by remaining in tension, the three lines of contact between the dust seal 26, the support shaft 120, and the boss 140 are maintained. As such, the dust seal 26 continually provides a tight resilient seal to prevent the ingress of contamination.

It should be recognized that the embodiments of the throttle valve assembly discussed above are intended to be illustrative of some presently preferred embodiments of the invention, and not limiting. Various modifications within the spirit and scope of the invention will be readily apparent to those skilled in the art. The invention is defined by the claims that follow.

The invention claimed is:

1. A throttle valve assembly for a carburetor used with an internal combustion engine, comprising:

a carburetor body having a fuel and air mixing passage and a valve chamber intersecting the fuel and air mixing passage and extending to a base of the valve chamber in the carburetor body;

a valve body at least partially disposed in the valve chamber and having an end received generally adjacent the base of the valve chamber, and a through bore at least partially received in the mixing passage for rotation therein to control at least in part the air-fuel mixture flowing through the mixing passage;

a fuel nozzle having an orifice communicating with the fuel and air mixing passage;

a needle valve carried by the valve body and adjacent to the orifice to control the open area of the orifice;

a cam follower received in the valve chamber adjacent the base and carried by the valve body; and a cam member constructed as a separate piece from the valve body and the carburetor body and being carried by the valve body for rotation in unison with the valve body and relative to the carburetor body, the cam member having at least one axially inclined cam surface engageable with the cam follower to move the valve body axially in response to rotational movement of said valve body about its axis to move the needle valve relative to the orifice.

2. The throttle valve assembly of claim 1 further comprising a cam follower received in the base of the valve chamber for engagement with the cam member.

3. The throttle valve assembly of claim 1 wherein the cam member is attached to said end of the valve body.

4. The throttle valve assembly of claim 1 wherein the cam member has an opening sized for receipt of the fuel nozzle therethrough.

5. The throttle valve assembly of claim 4 wherein the valve body has a recessed channel extending axially into one end defining an outer wall and an annular boss spaced radially inwardly from the outer wall, the boss being sized for receipt in the opening of the cam member.

6. The throttle valve assembly of claim 5 wherein a plurality of ribs extend radially between the outer wall and the boss.

7. The throttle valve assembly of claim 6 wherein the ribs have a lower surface spaced axially inwardly a predefined distance from the end of the valve body to facilitate locating the cam member within the channel.

8. The throttle valve assembly of claim 5 wherein the outer wall of the valve body has a plurality of ribs extending radially inwardly therefrom to facilitate locating the cam member at least in part within the channel.

9. The throttle valve assembly of claim 8 wherein the ribs have tips defining an inner diameter and the cam member has an outer diameter that is equal to or greater than the inner diameter.

10. The throttle valve assembly of claim 1 wherein the valve body has a recessed channel extending axially into the end defining an outer wall and further comprising a plurality of ribs extending radially inwardly from the outer wall to engage the cam member.

11. The throttle valve assembly of claim 10 wherein the channel defines at least in part an annular boss spaced radially inwardly from the outer wall, and the cam member has an opening sized for receipt of the boss.

12. The throttle valve assembly of claim 11 wherein the outer wall of the valve body is supported by a plurality of ribs extending radially between the outer wall and the boss.

13. The throttle valve assembly of claim 12 wherein the ribs have a lower surface spaced axially inwardly a predefined distance from the end of the valve body to facilitate locating the cam member axially with the channel.

14. The throttle valve assembly of claim 13 wherein the cam member is constructed from a material resistant to wear.

15. The throttle valve assembly of claim 13 wherein the valve body is constructed from a material that produces low friction with adjacent components.

16. The throttle valve assembly of claim 1 wherein the cam member is constructed from a material that is different from the material from which the valve body is constructed.

17. The throttle valve assembly of claim 1 wherein one of the cam member and the valve body includes a material characteristic that is not present in the other of the cam member and valve body.

18. A throttle valve assembly for a carburetor used with an internal combustion engine, comprising:

a carburetor body having a fuel and air mixing passage and a valve chamber intersecting the fuel and air mixing passage and extending to a base;

a valve body at least partially disposed in the valve chamber and having an end received generally adjacent the base of the valve chamber, a through bore at least partially received in the mixing passage for rotation therein to control at least in part the air-fuel mixture flowing through the mixing passage;

a fuel nozzle having an orifice communicating with the fuel and air mixing passage;

a needle valve carried by the valve body and adjacent to the orifice to control the open area of the orifice;

a cam member constructed as a separate piece from the valve body and being carried by the at least one of the carburetor body and the valve body, the cam member having at least one axially inclined cam surface to move the valve body axially in response to rotational movement of said valve body about its axis to move the needle valve relative to the orifice; and the valve body has one of a slot and tab, and the cam member has the other of said slot and tab, the slot being sized for mating engagement with the tab to attach the cam member to said end of the valve body.

19. The throttle valve assembly of claim 18 wherein said slot has a notch extending in a circumferential direction and said tab has a protrusion receivable in said notch providing a snap-fit retention of the cam member to the valve body.

20. A carburetor for an internal combustion engine, comprising:

a carburetor body having a fuel and air mixing passage and a valve chamber extending into the body, intersecting the fuel and air mixing passage, and having a base in the carburetor body;

a valve body at least partially received in the valve chamber for rotation therein to control at least in part the air-fuel mixture flowing through the mixing passage and having an end received generally adjacent the base, and a through bore selectively and variably aligned with the mixing passage;

a cam follower received in the valve chamber adjacent the base and carried by the carburetor body; and a cam member formed separately from the valve body and the carburetor body, received between the end of the valve body and the base, carried by the valve body for rotation in unison with the valve body and having an inclined surface engageable with the cam follower to move the valve body axially in response to rotational movement of the valve body.

21. The carburetor of claim 20 wherein the valve body has a recessed channel extending axially into said end and defining an outer wall and a radially inwardly spaced boss, and the cam member has an opening sized for receipt of the boss.

22. The carburetor of claim 21 wherein the outer wall has one of a slot and tab, and the cam member has the other of said slot and tab, the slot being sized for mating engagement with the tab.

23. The carburetor of claim 22 wherein said slot has a notch extending in a circumferential direction and said tab has a protrusion engageable with said notch to provide a snap-fit retention of the cam member to the valve body.

24. The carburetor of claim 20 wherein the cam member and valve body are constructed from different materials.

25. The carburetor of claim 24 wherein the cam member is constructed from a material resistant to wear.

26. The carburetor of claim 25 wherein the valve body is constructed from a material that produces low friction with adjacent components.

27. The carburetor of claim 20 wherein one of the cam member and the valve body includes a material characteristic that is not present in the other of the cam member and valve body.

28. The carburetor of claim 20 comprising:

a cap carried by the carburetor body and having an upper surface, a boss extending from the upper surface and defining at least in part an opening, and a flange extending outwardly from the boss and defining an annular recess between the flange and the upper surface;

a shaft carried by the valve body for rotation and translational movement within the opening of the cap; and a seal having a tubular wall with one end adapted to be received in the annular recess and another end adapted to be received about the shaft and spaced from the boss.

29. The carburetor of claim 28 wherein a pocket is defined at least in part by the flange and the seal.

30. The carburetor of claim 29 where a pair of axially spaced pockets are defined on opposite sides of the flange.

31. The carburetor of claim 28 wherein the seal is constructed from an elastomeric material.

32. The carburetor of claim 28 wherein the seal has a pair of ends and a mid-section with a diameter that is greater than the diameter of the seal at its ends.

33. The carburetor of claim 28 wherein the dust seal has a mid-section that in assembly is received over and expanded outwardly by the flange.

34. The carburetor of claim 33 wherein the seal engages adjacent components in at least three contact points with a separate contact point generally adjacent each end of the seal and another contact point at the flange and between the ends of the seal.

* * * * *

UNITED STATES PATENT AND TRADEMARK OFFICE

CERTIFICATE OF CORRECTION

PATENT NO. : 7,267,327 B2
APPLICATION NO. : 10/974518
DATED : September 11, 2007
INVENTOR(S) : Masashi Sasaki et al.

It is certified that error appears in the above-identified patent and that said Letters Patent is hereby corrected as shown below:

On Title Page
item (75) should read Inventors: Masashi Sasaki
Hitoshi Terakado

Signed and Sealed this

Twenty-fourth Day of June, 2008

JON W. DUDAS
*Director of the United States Patent and Trademark Office*